US005363773A

United States Patent [19]

Chuang

[11] Patent Number: 5,363,773

[45] Date of Patent: Nov. 15, 1994

[54] SLIDABLE FOLDING SHELF

[76] Inventor: Lai-Yeh Chuang, No. 1-2, Lane 975, Chun-Jih Road, Tao-Yuan City, Taiwan, Prov. of China

[21] Appl. No.: 110,516

[22] Filed: Aug. 23, 1993

[51] Int. Cl.[5] ..... A47B 11/00

[52] U.S. Cl. ..... 108/102; 108/115; 108/99; 211/153

[58] Field of Search ..... 108/73, 115, 59, 143, 108/137, 102; 211/149, 151, 153, 134, 662

[56] References Cited

U.S. PATENT DOCUMENTS

| | | | |
|---|---|---|---|
| 2,657,810 | 11/1953 | Garrick | 108/102 X |
| 3,986,616 | 10/1976 | Gray | 211/153 |
| 4,155,312 | 5/1979 | Thorkildson | 211/153 X |
| 4,811,875 | 3/1989 | DiSimone | 108/137 X |
| 5,137,160 | 8/1992 | Santucci | 211/153 |

*Primary Examiner*—Jose V. Chen

*Attorney, Agent, or Firm*—Morton J. Rosenberg; David I. Klein

[57] ABSTRACT

A novel shelf configuration comprises a plurality of juxtaposed shelf units. Each shelf unit has a straight or arc configuration. The shelf unit has a guiding track thereof facilitating a easy extension of the shelf unit to constitute a shelf. Besides, a T slot is disposed at the front end of shelf unit and a positioning tab is disposed at the rear end of the shelf unit. By engaging of a T slot and a positioning tab of an adjacent shelf unit, two adjacent shelf units can be firmly engaged. While the shelf is not in use, the positioning tab can be released from the T slot by a retaining tab which release the positioning tab. By this arrangement, a combined shelf unit can be released one by one providing a convenient utilization and storage.

1 Claim, 9 Drawing Sheets

SLIDABLE FOLDING SHELF

BACKGROUND OF THE INVENTION

This invention relates to shelf structures, more particularly, to a slidable folding shelf which can be easily extended and can be folded subsequent to use to provide ease of handling and provides an added convenience for the user.

Prior art shelves used for camping or roofing are generally made from a metal tube or some synthetic material. However such prior art systems have extended lengths and are heavy, resulting in complex handling problems. Additionally, molded shelves are difficult to store while not in use. Such a prior art molded shelf can only be mounted in a fixed position and is generally not for portable utilization.

FIG. 9 depicts an existing shelf used in camping, roofing and garage structures. The main frame of this type of shelf is connected by sleeving a plurality of tube members 11. Each tube member 11 has an insert portion 111 which can be received by the central portion 112 of an adjacent tube member 11. A bolt and nut member 12 is inserted into this connected portion for fixing the tube members together. The shelf structure E may be disassembled while not in use. However, assembly or disassembly requires a tool, such as a screw driver and a spanner. Additionally, each tube member 11 has a designated position whereby each and every tube member 11 is assembled according to a predetermined position, otherwise the shelf can not be assembled.

SUMMARY OF THE INVENTION

It is the object of this invention to provide a slidable folding shelf which can be easily assembled or disassembled manually without any tooling.

It is another object of this invention to provide a slidable folding shelf wherein each shelf unit remains in a connected state while in storage. By this arrangement, a shelf can be easily extended while in use.

In order to achieve the goal set forth, the subject slidable folding shelf is easily assembled by connecting a plurality of shelf units. Each shelf unit is constructed with a plurality of straight or arcuately directed tubes. An assembled shelf unit has a slidable track which facilitates ease of mounting to an adjacent shelf unit. By this arrangement, an easily installed slidable folding shelf is provided.

It is still another object of this invention to provide a slidable folding shelf which includes a T-shaped member for ease of connection with a tab disposed in a rear section of an adjacent shelf unit. This facilitates a simple and firm connection between adjacent shelf units.

BRIEF DESCRIPTION OF THE DRAWINGS

The structural and operational characteristics of the present invention and its advantages as compared to the known state of the prior art will be better understood from the following description, relating to the attached drawings which show illustratively but not restrictively an example of a slidable folding shelf in accordance with the invention concept.

Figure 7:
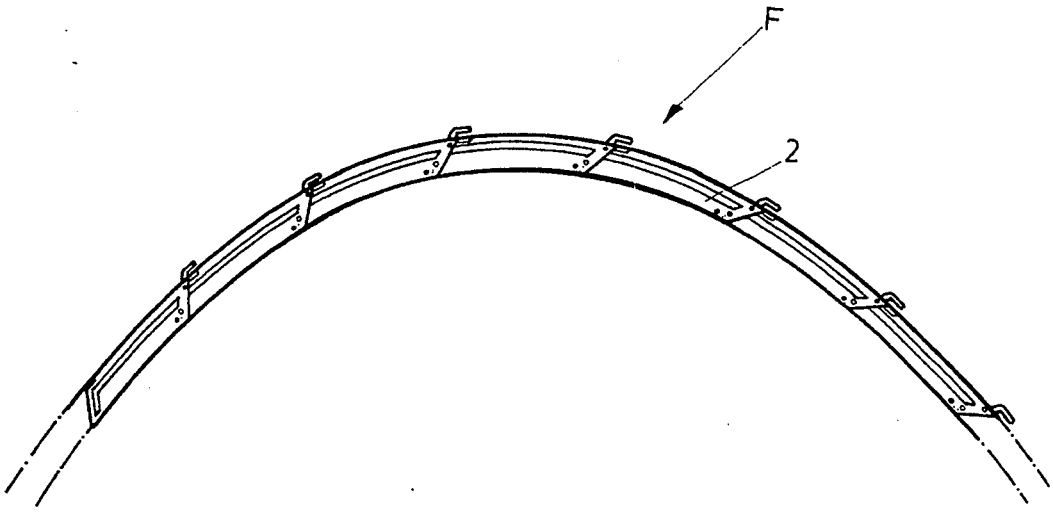
Figure 8:
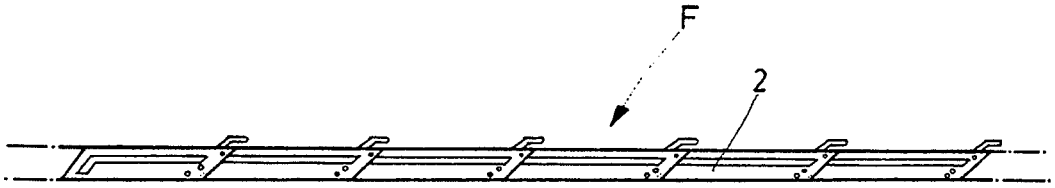
Figure 9:
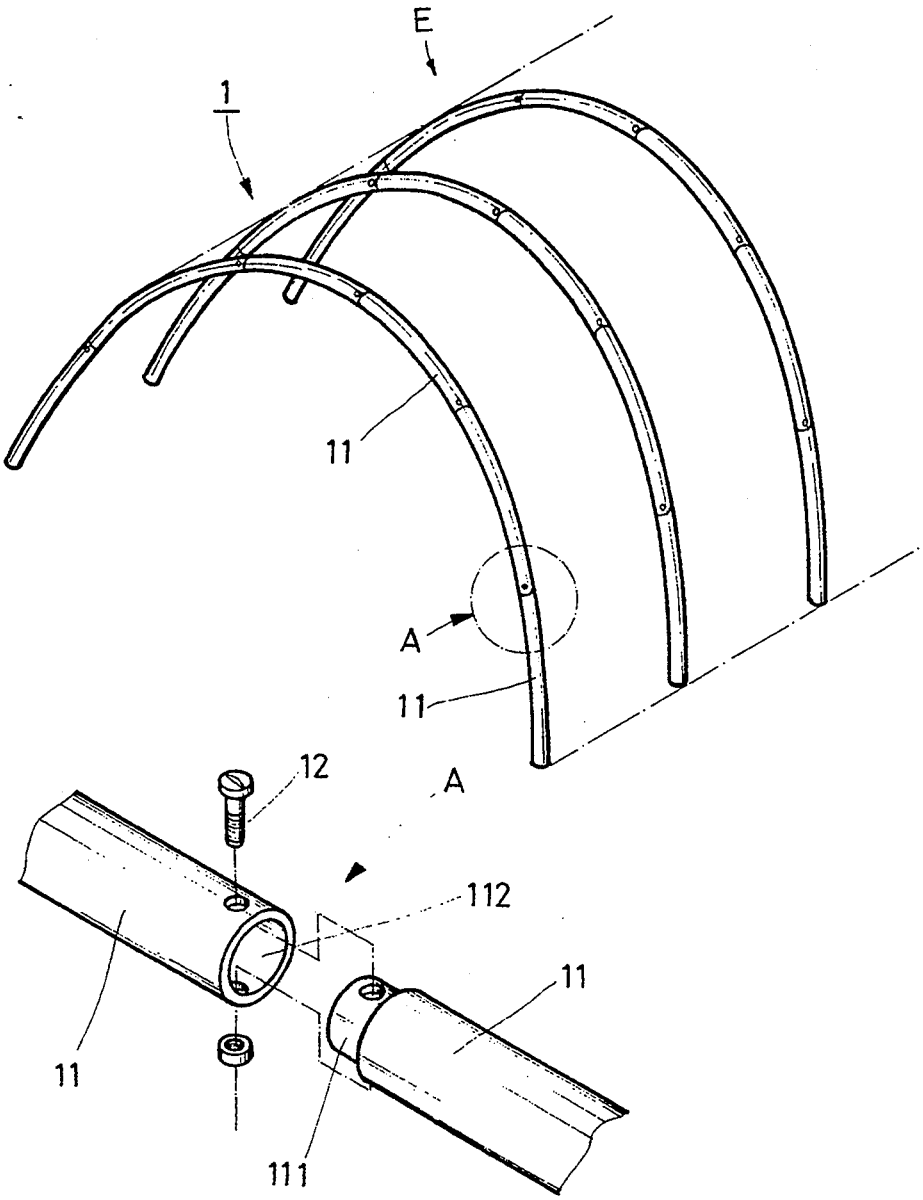
PRIOR ART FIG.9

FIGS. **6*a*–6*e*** are a partial cross-sectional view of a plurality of connected shelf units, wherein the shelf unit is folded consecutively;

FIG. 7 is a schematic view of an arcuately directed slidable folding shelf;

FIG. 8 is a schematic view of a linearly directed slidable folding shelf made according to the invention concept; and, FIG. 9 is a schematic view of a prior art shelf.

BRIEF DESCRIPTION OF THE PREFERRED EMBODIMENT

Figure 1:
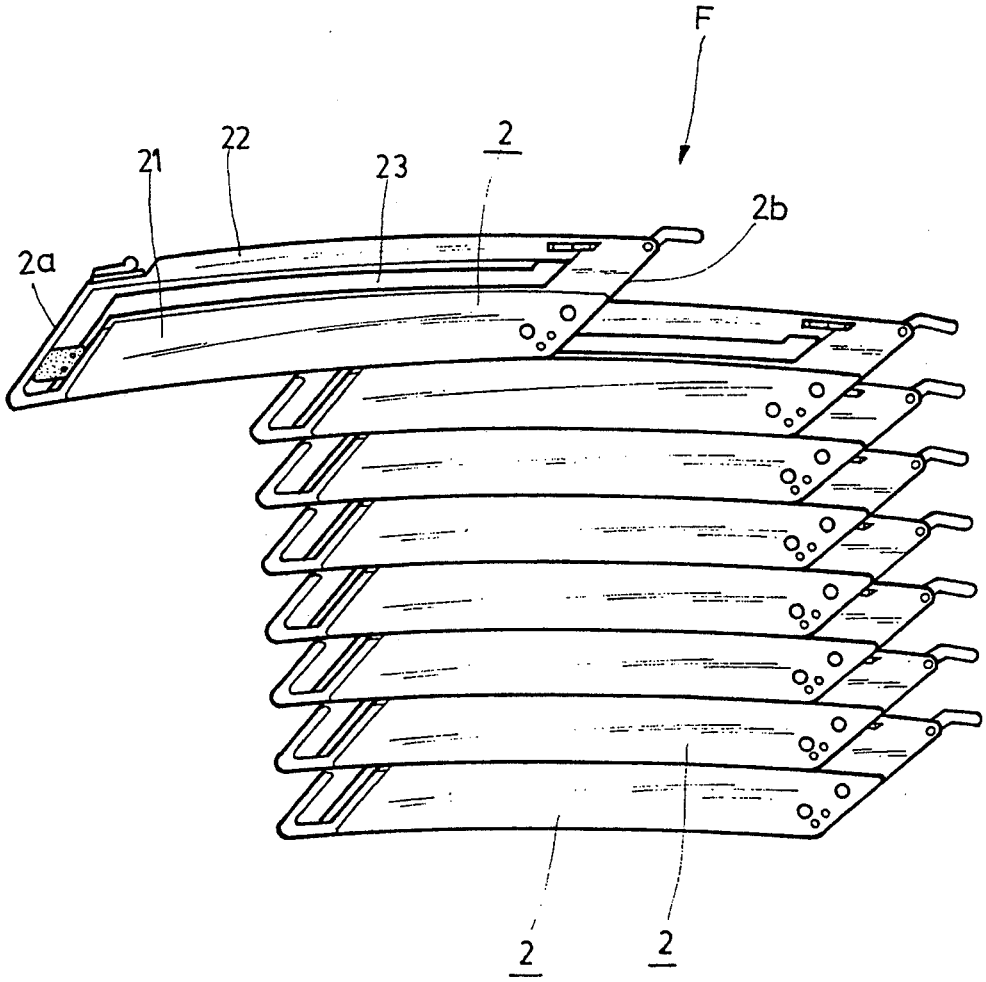
FIG. 1 is a perspective view of a slidable folding shelf in a stored position, showing a plurality of shelf units.
Figure 2:
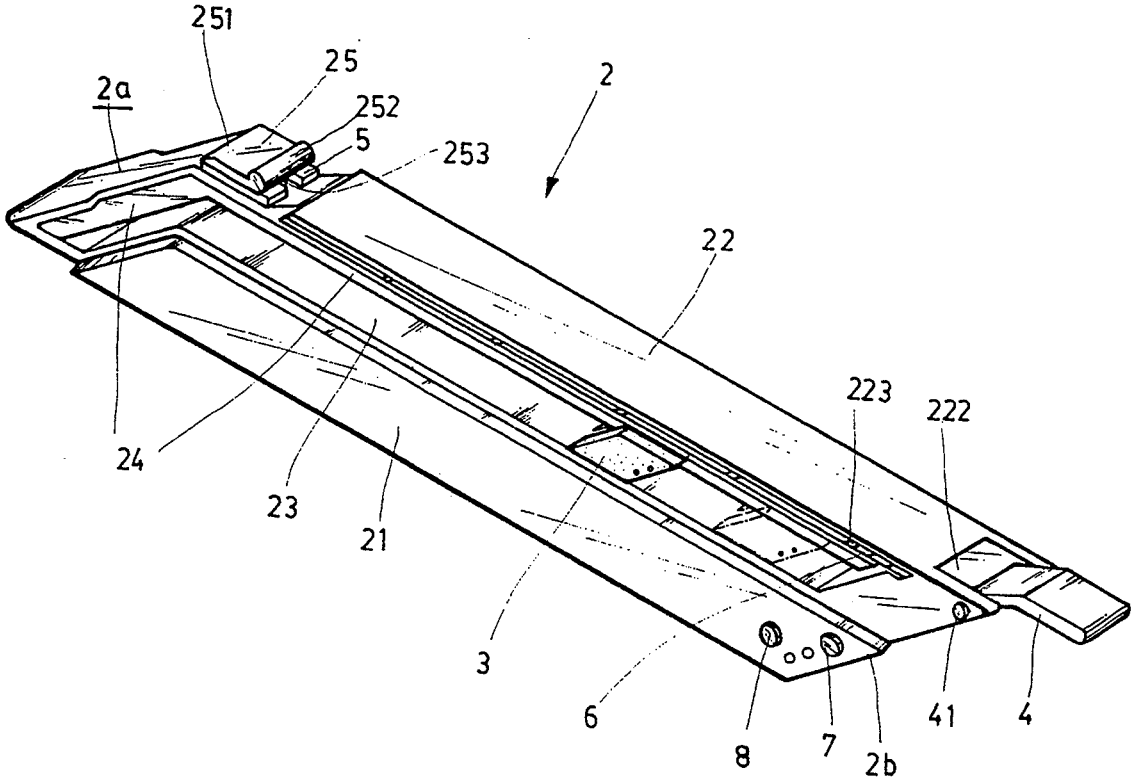
FIG. 2 is a perspective view of a slidable folding shelf made according to the subject invention concept.
Figure 3:
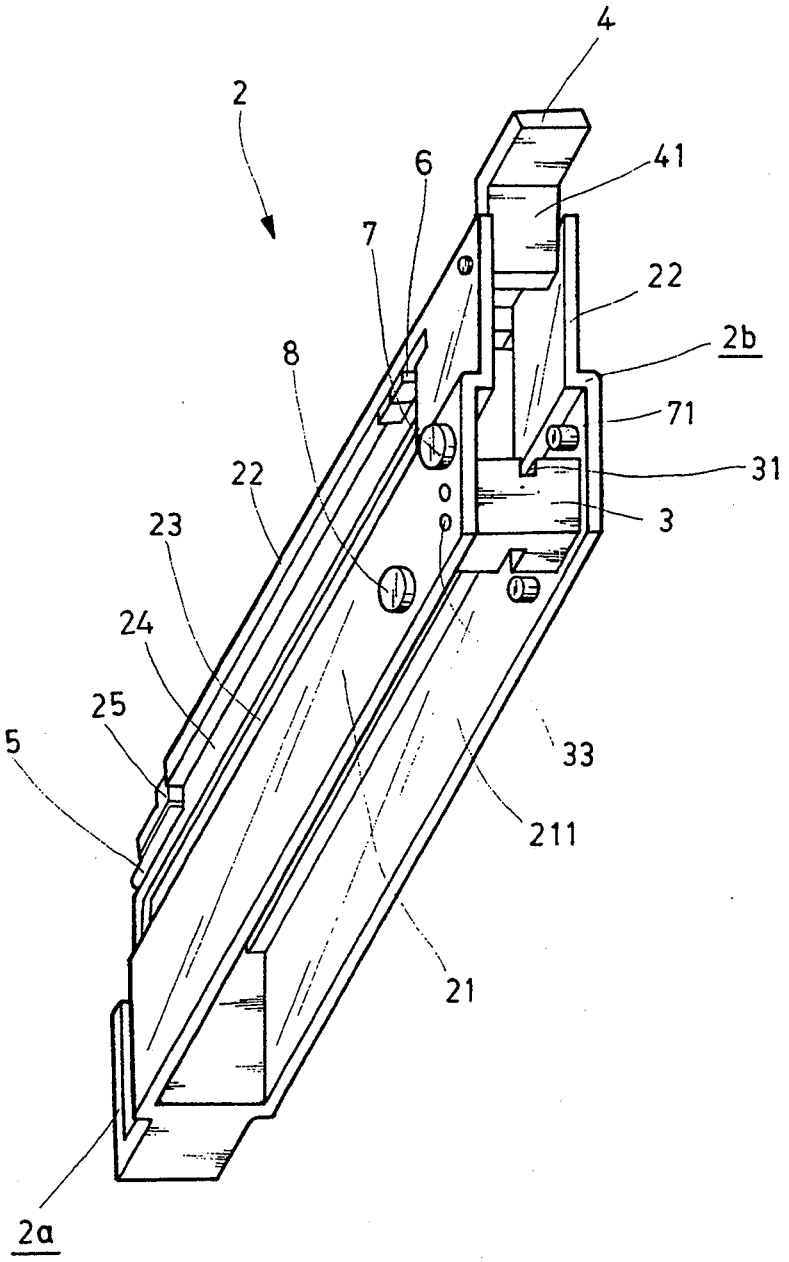
FIG. 3 is a further perspective view of a slidable folding shelf.
Figure 4:
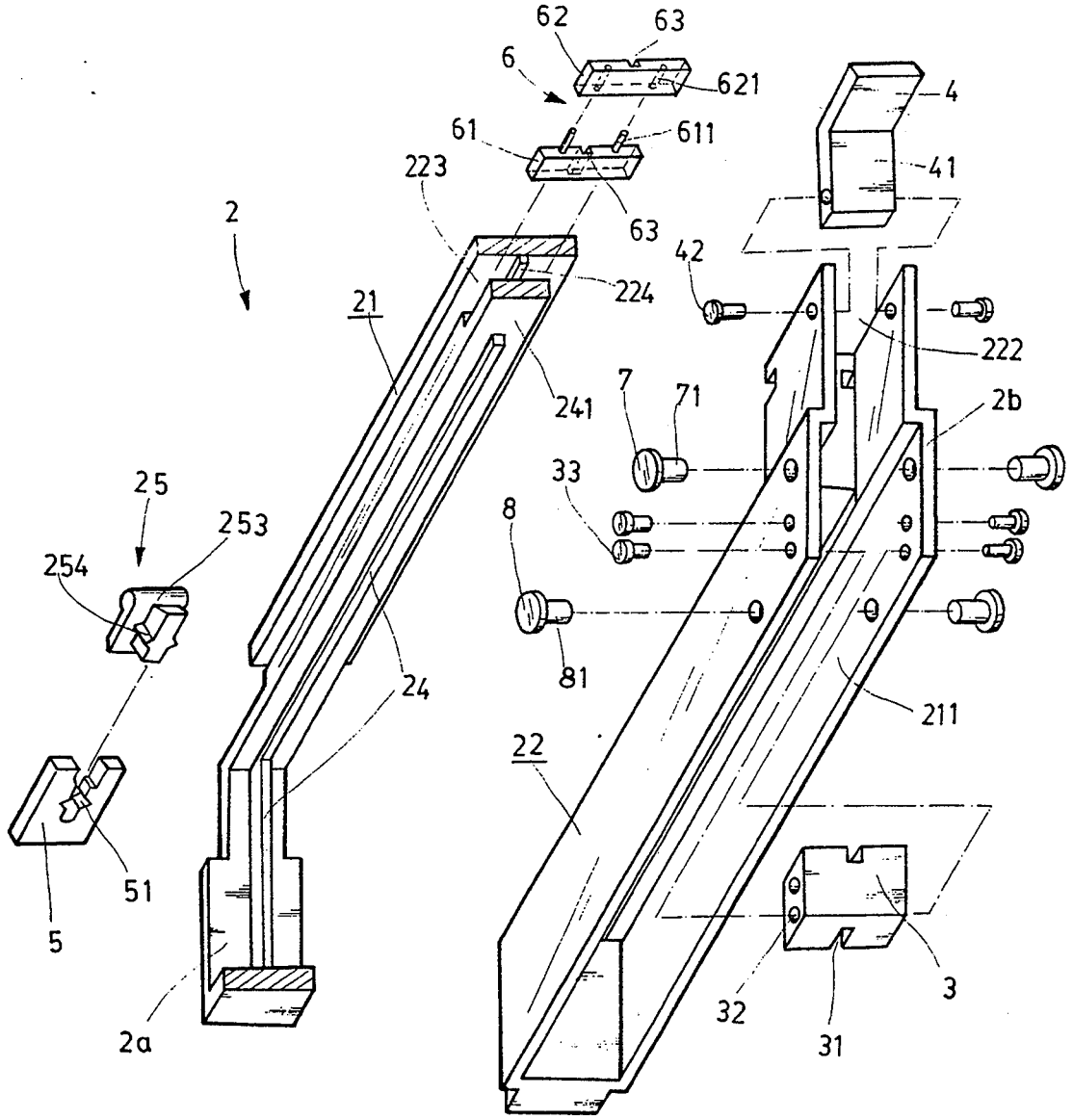
FIG. 4 is a perspective view of a disassembled shelf unit.

Referring now to FIGS. 1–4, there is shown shelf F formed according to this invention which includes at least two shelf units 2. Each shelf unit 2 may be linearly directed in a longitudinal direction as shown in FIG. 8 or may be arcuately contoured as shown in FIG. 7. The front end **2*a* and rear ends 2*b* are inclined forwardly and parallel to each other forming a generally parallelogram contour as shown. The lower portion of the shelf unit 2 has a wider portion including the lower members 21. The upper portion defines a narrow portion or upper member 22 which is spaced apart from the lower member 21 defining a hollow track or space 23 disposed between the narrow portion or upper member 22 and wider or lower members 21. This hollow track or space 23 is inclined at front end 2*a* and extends longitudinally as is shown in FIG. 2. Above the hollow track 23, a guiding track 24 is formed along the edge of the narrow portion or upper member 22. A cutout section 241 is provided for the guiding track 24 as shown in FIG. 4. A T-shaped member 25 is connected at the front portion 2*a* of the narrow portion or upper member 22. The T-shaped member 25 has an inclined surface 251 at a front end and a projected portion 252 at a rear end. Projected portion 252 has an inclined surface 253 with respect to an inclined surface 221 of the narrow portion or upper member 22. The wider or lower member 21 has a hollow portion 211 for receiving the narrow portion 22 of a next consecutive shelf unit 2**.

A sliding block 3 with a diamond shape has a slot 31 formed therein. A threaded hole 32 is provided at an edge portion of block 3. The sliding block 3 facilitates easy entrance of the guiding track 24 from the cutout 241. Guiding track 24 may be slidably displaced within slot 31 facilitating the movement of the sliding block 3 in the hollow .guiding track or space 23. A screw member 33 is threaded onto the sliding block 3 through the opening of the wider portion 21 of the shelf unit 2 whereby the upper portion and lower portions are connected.

An inclined L-shaped positioning tab 4 includes inclined surface 41. Inclined tab 4 is attached within the cutout 222 of the wider portion 22 through a screw 42 as shown in FIG. 4. Tab member 4 is moved upward and downward as shown in FIGS. **6*b*, *c***.

A clip type retaining tab 5 is releasably engaged with the T-shaped member 25. A slot 51 is provided on the inside of the T-shaped member 25 respective to the V-shaped portion 254 provided on opposing sides of the T-shaped member 25.

An actuating member 6 is formed by two actuating blocks 61, 62. The two actuating blocks 61, 62 are coupled together by a post 611 and hole 621. The blocks 61, 62 have a slot 63 formed in an upper surface thereof as shown in FIG. 6a. The actuating member 6 is slidably mounted in the displacing hole 223 of the narrow portion of upper member 21 and movable therein. The actuating block 61 with a post member 611 is first inserted from the cutout 225 of the guiding slot 224, then pushed into its designated position on the guiding slot 224. After that, the actuating block 62 with a hole 621 is inserted through the cutout 225. By this arrangement, the actuating blocks 61 and 62 are connected together and move freely in the displacing hole 223 along guiding slot 224.

A striking pin 7 is disposed at both sides of the wider portion or lower members 21. The striking pin 7 extends into the hollow portion 211 through the lower members 21.

A positioning pin 8 is disposed on a corner portion of the lower members 21. The position pin 8 is extended into the hollow portion 22 and under the sliding track 23 of a lower shelf 2.

By the combination of the above described members, the narrow portion or upper member 22 of each individual shelf unit 2 can be received into the hollow portion 211 through the wider portion or lower members 22. By inserting a screw 33, the sliding block 3 is secured on the sliding track 23. By this arrangement, the shelf made according to this invention facilitates an easy installation and convenience for storage while not in use.

A further description will be given for the utilization and movement of the shelf. Referring to FIG. 1, the slidable folding shelf is juxtaposed as it is stored. This favors a compact volume of the shelf. The shelf can be designed with a straight or arc configuration respectively shown in FIGS. 8 and 7. If the shelf has an arcuate configuration, then it constructs a plan shape shelf F as shown in FIG. 7. If the shelf has a straight or linear configuration, then it constructs a plan shape shelf F as shown in FIG. 8. The user can extend the length of the shelf F according to his or her necessity of use.

Referring to FIG. 2, for assembly purposes, sliding block 3 is inserted from the cutout 241 of the guiding track 24. The sliding block 3 is moved forward to the sliding track 23 located at the front inclined end 2*a* of the shelf unit. Now referring to FIGS. 3 and 4, the front tilted or inclined end 2*a* of a shelf unit 2 is inserted into a hollow portion 211 of a wider portion 21 of an adjacent shelf unit 2. A screw 33 is fixed from the side of the wider portion 21 and the sliding block 3 is attached onto the inner side of the wider portion 21. By this arrangement, the wider portion 21 of the upper shelf unit 2 is located above the narrow portion 22 of the lower shelf unit 2. Then it can slide forwardly to extend the length of the shelf F according to the configuration of the sliding track 23.

Figure 5:
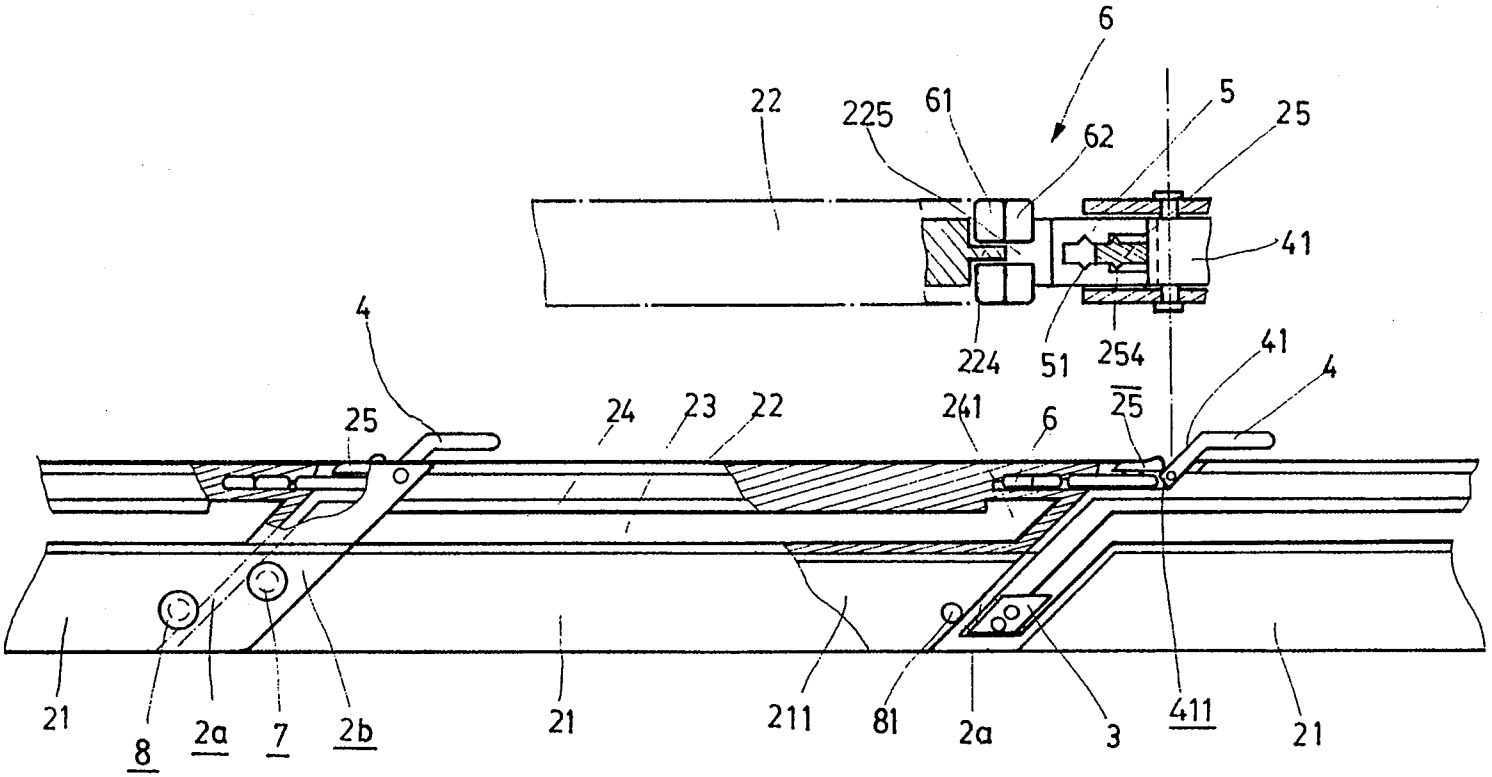
FIG. 5 is an assembled partially cross-sectional view of a plurality of connected shelf units wherein the shelf is totally extended.

Referring to FIG. 5, as the shelf unit 2 is moved backward, a retaining tab 2 of an upper shelf unit 2 is pressed or contacted by the front inclined surface 41 and the front end 411 is received by the T-shaped member 25. By this arrangement, each retrieved shelf unit 2 is locked manually without using any tooling.

Figure 6:
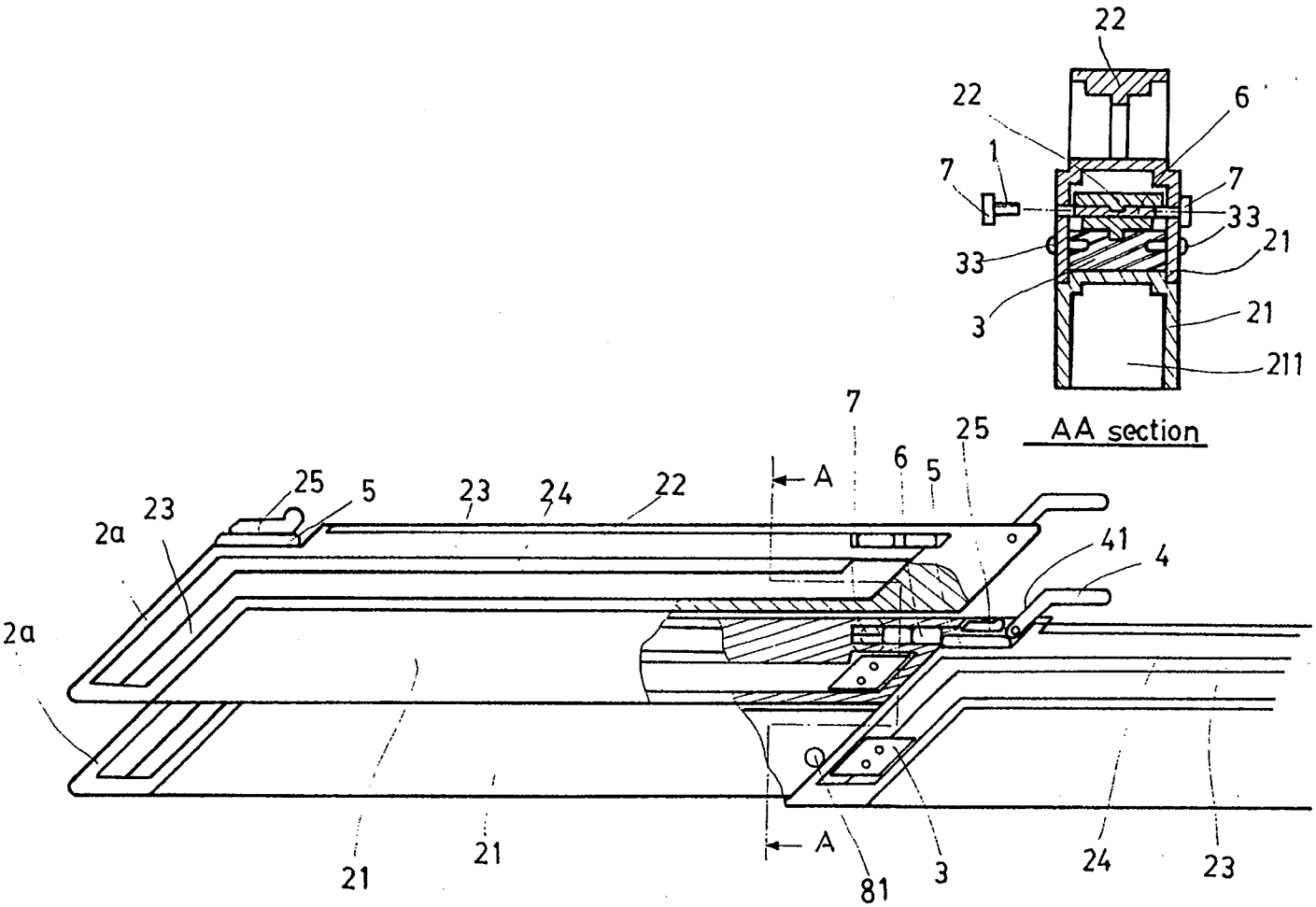
Figure 6A:
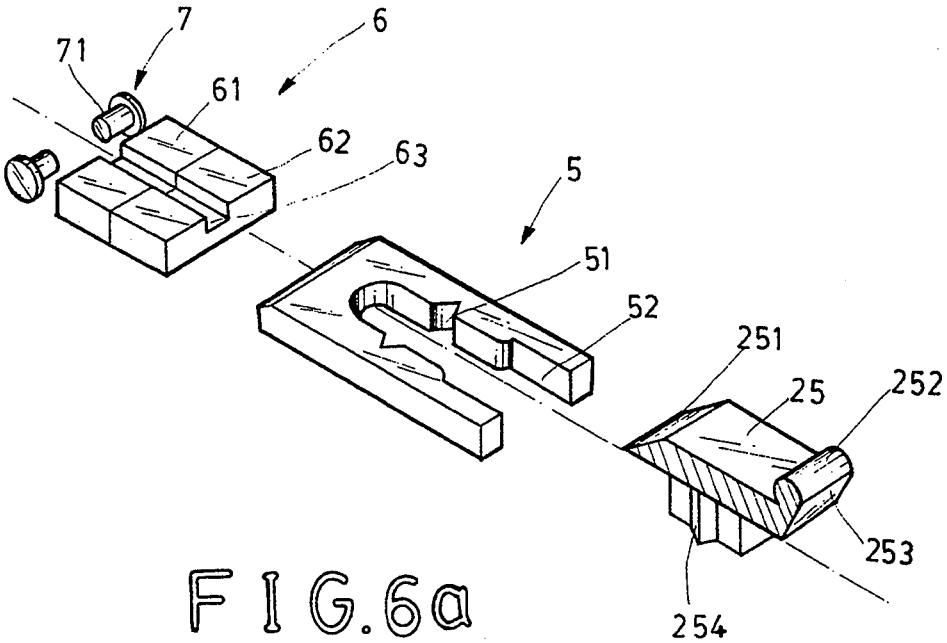
Figure 6B:
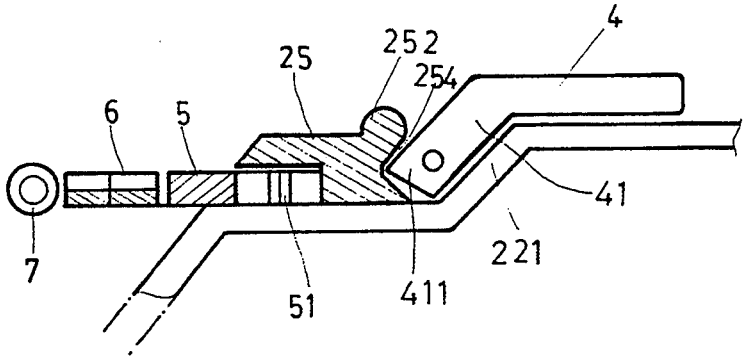
Figure 6C:
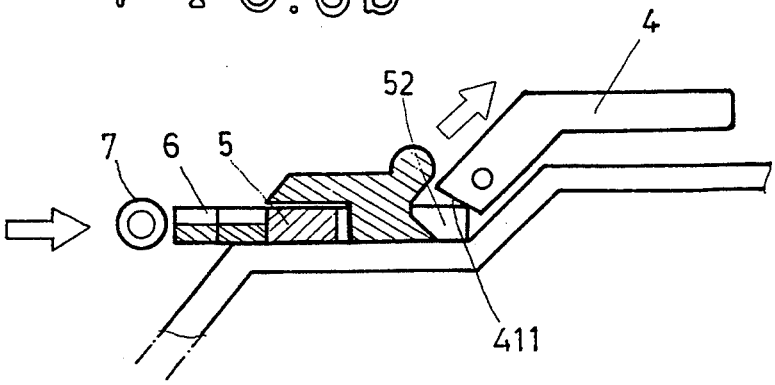

Referring to FIGS. 5 and 6, two adjacent shelf units 2 are locked together through an engagement of a positioning tab 4 received by a T-shaped member 25. In light of this, to extend a plurality of juxtaposed shelf units 2, the positioning tab 4 must be released from the T-shaped member 25. In order to accomplish this and referring to FIGS. 6*a*, 6*b* and 6*c*, the T-shaped member 25 is disposed at the front end of shelf unit 2 and the positioning tab 4 is disposed at the rear end of an adjacent shelf unit 2. Hence the positioning tab 4 is above the T-shaped member 25. An inclined surface 253 is disposed at the underside of the projected portion 252 disposed at the rear end of the T-shaped member 25. The positioning tab 4 is locked therein. The retaining tab 5 has a larger cutout at its front end 52 and envelopes the T-shaped member 25. As a shelf unit 2 is retrieved, striking pin 7 forces the actuating member 6 to strike the retaining tab 5 and the retaining tab 5 moves inwardly. The slot 51 of the retaining tab 5 rests on the projected portion 254 of the T-shaped member 25. As shown in FIG. 6, the positioning tab 4 is forced out of the front end 52 of the retaining tab 5 and released from the T-shaped member 25. By this arrangement, a plurality of shelf units 2 will be released one by one by a natural striking force whereby the shelf is easily stored.

Additionally, the stem 81 of the positioning pin 8 extends into the hollow portion 21I, as two adjacent shelf units 2 are locked up, the positioning pin 8 is moved to the outside of the narrow portion 22 and the striking pin 7 will move the inside of the narrow portion 22, hence the pins 7 and 8 constitute a cross support on opposing sides of the narrow portion 22 as the shelf units 2 are extended to a constructed shelf.

Although the present invention has been described in connection with the preferred embodiment thereof, many other variations and modifications will now become apparent to those skilled in the art without departing from the scope of the invention. It is preferred, therefore, that the present invention not be limited by the specific disclosure herein, but only by the appended claims.

I claim:

1. A slidable folding shelf comprising:

(a) at least a forwardly and rearwardly slidably connected pair of longitudinally extending shelf units having longitudinally opposing inclined rear and front end surfaces, each of said shelf units having a pair of lower members spaced apart each from the other in a direction normal said longitudinal direction forming a hollow space therebetween and an upper member mounted to an upper section of said lower members and extending contiguous a front section of said lower members forming said front end of each of said shelf units, said upper member and said lower members forming a longitudinally directed hollow space therebetween, said upper member having a longitudinally directed guide track member formed on a lower surface thereof, said rear end of said spaced apart lower members forming an insertion cutout section for insertion therein of an upper member of another shelf unit;

(b) a T-shaped member mounted to a front end of said upper member of each of said shelf units, said T-shaped member having a projection knob formed on a rear end thereof and an inclined frontal surface;

(c) a slide block having a slide block slot formed therein, said guide track member being slidably inserted within said slide block slot, said slide block being threadedly secured to said lower members;

(d) an inclined L-shaped positioning tab mounted to said spaced apart lower members within said insertion cutout section;

(e) a retaining tab having a longitudinally directed tab slot for insert therein of said T-shaped member, said T-shaped member being releasably captured by said retaining tab;

(f) actuating means for contacting an end surface of said retaining tab and displacing said retaining tab, said actuating means including a pair of longitudinally aligned actuating block members having an actuating slot formed within an upper surface thereof for sliding cooperation with a longitudinally directed guiding track formed on a lower surface of said upper member;

(g) a striking pin extending through said pair of lower members and said hollow space for contacting said actuating block members; and, (h) a positioning pin extending through said pair of lower members and said hollow space for securing said lower members in said spaced apart relation, said upper member of said forwardly directed shelf unit being inserted within said hollow space of said rearwardly directed shelf unit for engagement with said positioning tab of said rearwardly directed shelf unit.

* * * * *